US006109146A

United States Patent [19]

Muro

[11] Patent Number: 6,109,146

[45] **Date of Patent: *Aug. 29, 2000**

[54] CONTINUOUS SCREW FASTENING MACHINE

[75] Inventor: Narahiko Muro, Tokyo, Japan

[73] Assignee: Muro Corporation, Tokyo, Japan

[ * ] Notice: This patent is subject to a terminal disclaimer.

[21] Appl. No.: 09/242,878

[22] PCT Filed: Sep. 25, 1997

[86] PCT No.: PCT/JP97/03407

§ 371 Date: Apr. 22, 1999

§ 102(e) Date: Apr. 22, 1999

[87] PCT Pub. No.: WO99/00222

PCT Pub. Date: Jan. 7, 1999

[30] Foreign Application Priority Data

Jun. 30, 1997 [JP] Japan ..... 9-190585

[51] Int. Cl.[7] ..... B25B 23/06

[52] U.S. Cl. ..... 81/434; 81/435

[58] Field of Search ..... 81/434, 435

[56] References Cited

U.S. PATENT DOCUMENTS

| | | | |
|---|---|---|---|
| 4,517,863 | 5/1985 | Ishikawa . | |
| 5,186,085 | 2/1993 | Monacelli | 81/434 |
| 5,452,630 | 9/1995 | Haas et al. | 81/434 |
| 5,473,965 | 12/1995 | Chen | 81/434 |
| 5,531,142 | 7/1996 | Adamo | 81/434 |
| 5,931,366 | 8/1999 | Muro | 227/137 |

FOREIGN PATENT DOCUMENTS

| | | | |
|---|---|---|---|
| 62-6955 | 2/1987 | Japan | B25B 23/06 |

*Primary Examiner*—James G. Smith
*Assistant Examiner*—David B. Thomas
*Attorney, Agent, or Firm*—Sughrue, Mion, Zinn, Macpeak & Seas, PLLC

[57] ABSTRACT

In the case that the screw is to be driven, the extremity end of the screw chain is lifted up in an upward direction, thereby even if the screw having a flat seat surface is applied, the screw is driven under an appropriate state without holding the screw chain having some spaced-apart screws therein between it and the seat surface of the head section of the screw. The screw rope guide 26 having at one end the guide passage 24 and having at the other end the shaft hole 25 is rotatably pivoted to the screw feeder mechanism body 6 slid freely in a forward or rearward direction, there is provided the resilient member 28 for biasing the guide passage 24 of the screw chain guide 26 toward the screw feeder mechanism body 6 in a downward direction, the drive unit body 3 is provided with the pushing section 32, the pushing section 32 is abutted against the lower part 26*a* of the screw chain guide 26 near the shaft hole 25, the guide passage 24 of the screw chain guide 26 is pushed up in an upward direction, the screw chain 11 inserted into the guide passage 24 can be lifted up in a forward and upward direction of the feeding direction in cooperation with the driving operation of the bit 7.

4 Claims, 13 Drawing Sheets

CONTINUOUS SCREW FASTENING MACHINE

BACKGROUND OF THE INVENTION

1. Field of the Invention

This invention relates to a successive screw feeder driver operated such that when a screw for use in fixing a plate material such as a wooden plate or a metallic plate or the like against a wall surface or a floor surface or the like in a successive manner, a screw chain having some screws connected continuously is lifted up to prevent this screw chain from being wound around a seat surface of a screw head section.

2. Description of the Related Art

In the prior art, it has been proposed to provide a successive screw feeder driver 51 capable of driving the screws in a successive manner to fix a plate member such as a wooden plate or a metallic plate or the like against a wall surface or a floor surface and the like. As shown in FIGS. 11 and 12, this type of successive screw feeder driver 51 is constructed such that a rod-like bit 54 for use in driving a screw which corresponds to a screw driver of a normal type tool is arranged at the front section of a screw driving mechanism body 53 having a drive unit 52 stored therein and the bit 54 is rotated by the drive unit 52 to drive each of the screws S.

In the case that the screw S is driven by the prior art successive screw feeder driver 51, a worker loads a screw chain 11 having many screws S, S . . . successively arranged side by side on a fine rope in the main body 55 of the screw feed mechanism body 55 located at the extremity end of the successive screw feeder driver 51 as shown in FIG. 12 and then arranges the leading end screw S of the screw chain 11 at a drive action applying position set by the bit 54. The worker inserts the extremity end 11*a* of the screw chain 11 projected toward a side part of the screw S into a guide passage and further the worker gradually drives the screw S against the wall surface or the like with the bit 54 rotated at this position by the drive unit 52. The screw feed mechanism body 55 gradually moves back toward the screw driving mechanism body 53 in concurrent with the driving of the screw S. The screw feed mechanism body 55 abuts against the screw driving mechanism body 53 and stops. At this time, a clutch of the machine is released to complete a driving work for one piece of the screw S.

However, as shown in FIGS. 13(*a*) and (*b*), the aforesaid prior art successive screw feeder driver 51 had a problem that the screw chain 11 with the screw S being removed away from it is held between the seat surface C of the screw S and the wall surface or the like. In addition, in the case that the screw chain 11 having such a screw S as above removed from it is held between the screw S and the wall surface or the like, a next screw S placed to the former one in the screw chain 11 is sometimes transferred while it is being kept in its inclined state. Accordingly, there was a problem in the prior art successive screw feeder driver 51 that the screw S can not be driven under its appropriate state. Further, the extremity end of the rotating bit 54 was displaced from the engaging position of the head section of the screw S and the screw S could not be rotated.

In view of the foregoing, as shown in FIGS. 14(*a*), (*b*), the screw S applied in the successive screw feeder driver 51 was made in the prior art such that a part between the head section of the screw S and the threaded part of it was formed into an inverse-conical shape, a so-called pan shape. This screw S has some structural features that a ring-like portion holding the screw chain 11 may easily be cut and then the screw chain 11 can be easily released from the head section of the screw S.

In the case that the screw S is transferred to the driving action applying position, a feeder claw 57 constituting the screw feeder mechanism is operated as shown in FIGS. 15(*a*), (*b*), (*c*) and (*d*). At first, the feeder claw 57 is engaged with the threaded part of the screw S (FIG. 15(*a*)). Then, the screw S is transferred up to the driving action applying position at the upper surface of the screw feed mechanism body 55 (FIG. 15(*b*)). The extremity end 57*a* of the feeder claw 57 passes below the threaded part of the subsequent screw S while it is being rotated against a spring force and inclined in concurrent with the driving operation of the screw S (FIG. 15(*c*)). Lastly, it is recovered and moved upright in such a way that the extremity end part 57*a* of the feeder claw 57 is projected out at the side surface of the threaded part of the subsequent screw S (FIG. 15(*d*)). However, the extremity end part 57*a* of the feeder claw 57 is merely made to be steep. Due to this fact, in the case that the subsequent screw S is released from its predetermined position and the extremity end part 57*a* of the feeder claw 57 can not pass below the threaded part under a state in which it is being inclined, the feeder claw 57 can not be recovered back and made to be upright in such a way that the extremity end part 57*a* is projected at the side surface of the threaded part. There occurred a problem that the screw S is transferred in an idling manner due to the fact that this feeder claw 57 can not hold the subsequent screw S, but moves up to the driving action applying position of the bit 54.

The present invention has been invented in view of the aforesaid problems and it is an object of the present invention to provide a successive screw feeder driver in which even if the screw has a flat seat surface, this screw can be driven under an appropriate state against the fixed surface without causing the screw chain to be held between it and the seat surface of the head part by lifting up the extremity end of the screw chain in an upward direction when the screw is driven.

SUMMARY OF THE INVENTION

The successive screw feeder driver of the present invention has as its gist an arrangement in which a bit for driving a screw is rotatably inserted into a screw feeder mechanism body freely slid in a forward or rearward direction, the bit is removably arranged at the front section of a rotary main shaft, a drive unit is connected to the rotary main shaft, the screw feeder mechanism body is provided with a screw feeder mechanism comprised of a feeder claw for feeding each of the screws in a screw chain in sequence to a driving action applying position with the bit in cooperation with a sliding motion of the screw feeder mechanism body in a forward or rearward direction, a screw chain guide having a guiding passage at one end thereof and provided with a shaft hole at the other end thereof is rotatably pivoted to the screw feeder mechanism body, the pivoted section is provided with a resilient member for biasing the guiding passage for the screw chain guide against the upper surface of the screw feeder mechanism body in a downward direction, a pushing section abutted against the lower part near the shaft hole of the screw chain guide is projected and arranged at the driving machine body, the guide passage side of the screw chain guide is pushed upwardly by the pushing section and then the screw chain inserted into the guide passage can be lifted up in an upward direction in cooperation with a drive action of the bit.

The guide passage in the screw chain guide is of a cylindrical member having a slight wider inner diameter than an outer size of the screw chain. In addition, a hook section can be formed at the extremity end of the feeder claw constituting the screw feeder mechanism, or a screw cover can be arranged at the upper surface of the screw feeder mechanism body in such a manner that it can be raised up or descended and then the inner surface of the screw cover can be formed with a groove for the head section of the screw arranging in a vertical direction in respect to a screw driving direction.

In accordance with the aforesaid configuration, a worker arranges the leading screw at the screw chain at the bit driving action applying position in the screw feeder mechanism body and concurrently inserts the screw chain projected to the side part of the screw into the guide passage of the screw chain guide. The worker pushes the bit against the head section of the screw while the drive unit is being rotated with the abutting surface of the leading end block of the screw feeder mechanism body at this position being pushed against the plate member or the like, resulting in that a clutch is engaged and the bit is rotated to enable the screw to be gradually driven against the plate member or the like. In concurrent with this driving of the screw, the leading end block of the screw feeder mechanism body is retracted gradually toward the drive unit body having the drive unit stored therein and further the block is stopped at its predetermined position and the clutch is disengaged to complete the driving operation for one screw.

The lower portion of the screw chain guide pivoted to the side surface of the screw feeder mechanism body retracted in concurrent with this driving of the screw is abutted against the extremity end of the pushing section of the drive unit body. At this time, the screw chain guide is turned around a fulcrum point of the pivoted shaft in an upward direction so as to lift up the screw chain inserted into the guide passage located at the extremity end of the screw chain guide. Since the screw is driven against the wall surface or the like when the screw chain is being lifted up, the seat surface of the screw does not drive the screw chain together.

Then, the worker removes the leading end block of the screw feeder mechanism body from the plate member. The screw feeder mechanism body is moved away from the drive unit body, the pushing section for keeping the lower part of the screw chain guide pushed up is also moved away from it and the screw chain guide returns the guide passage to the predetermined position at the upper surface of the screw feeder mechanism body with a biasing force around a center of rotation of the pivoted shaft. In concurrent with this operation, when the screw feeder mechanism body is pushed out to its original position, the screw feeder mechanism is operated, the feeding claw pushes out the subsequent screw in the screw chain to the driving action applying position and then the screw driving operation can be carried out in the same operation as that described above. In this way, many screws can be driven in a continuous manner.

The feeding claw formed with the hook section at its extremity end is operated such that the hook section is abutted against it to hold the range of about ⅓ at the circumference of the threaded part of the screw and the screw can be moved to the driving action applying position under a state in which the screw is held positively. In addition, the system in which the inner surface of the screw cover of the screw feeder mechanism body is formed with a groove for the head section of the screw enables the screw at the subsequent position in the screw chain to be moved to the driving action applying position under an appropriate state due to the fact that the head section of the screw may easily be slid between this groove and the groove at the screw feeder mechanism body.

DESCRIPTION OF THE PREFERRED EMBODIMENT

Figure 1:
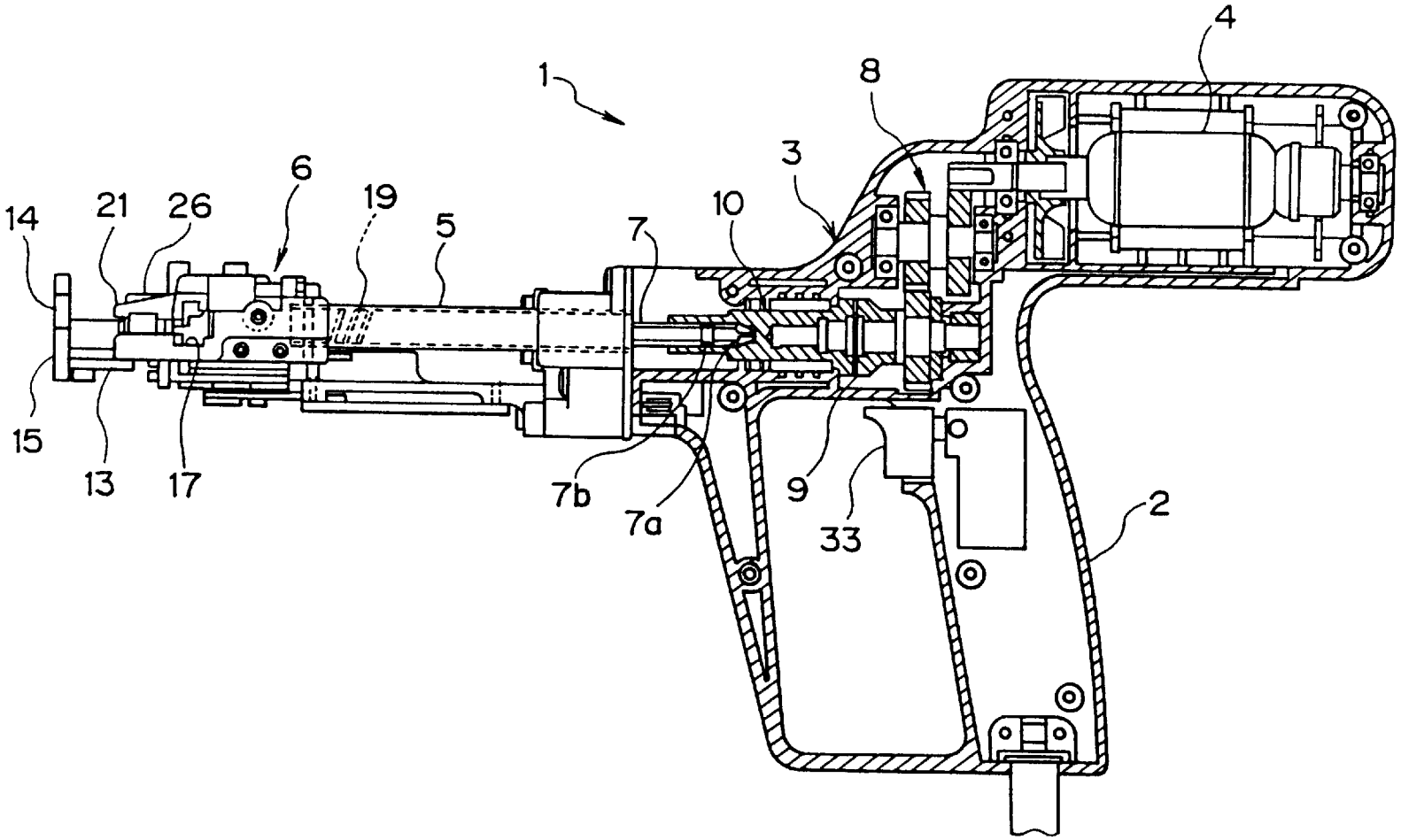
FIG. 1 is a side elevational view in section for showing a substantial part to illustrate a preferred embodiment of the successive screw feeder driver of the present invention.
Figure 2:
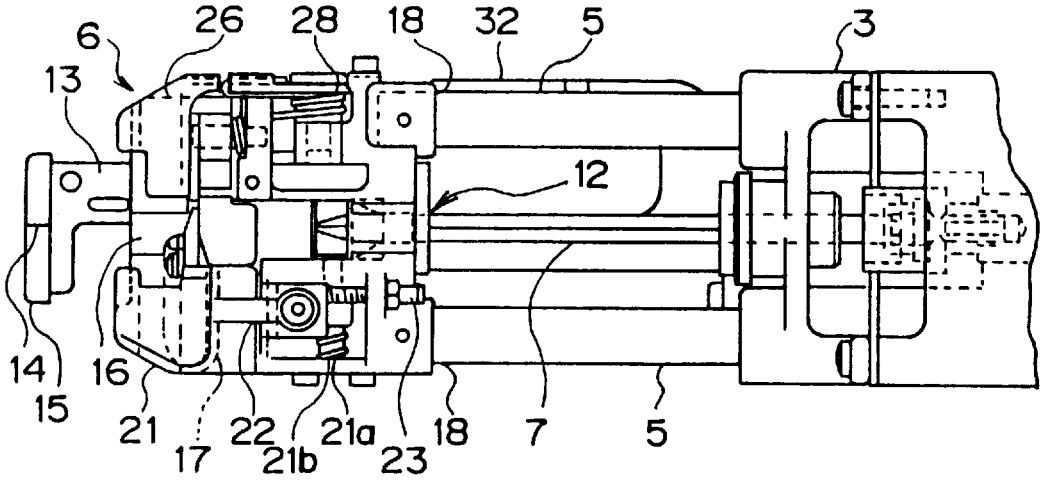
FIG. 2 is similarly a top plan view for showing the screw feeder mechanism body.
Figure 3:
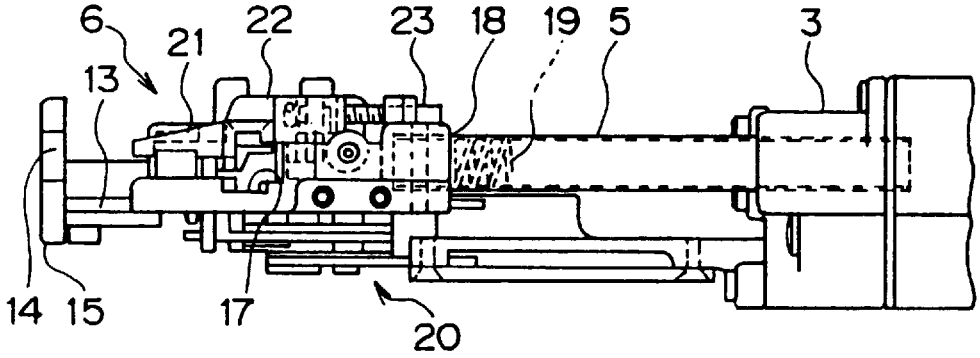
FIG. 3 is similarly a side elevational view for showing the screw feeder mechanism body.
Figure 4:
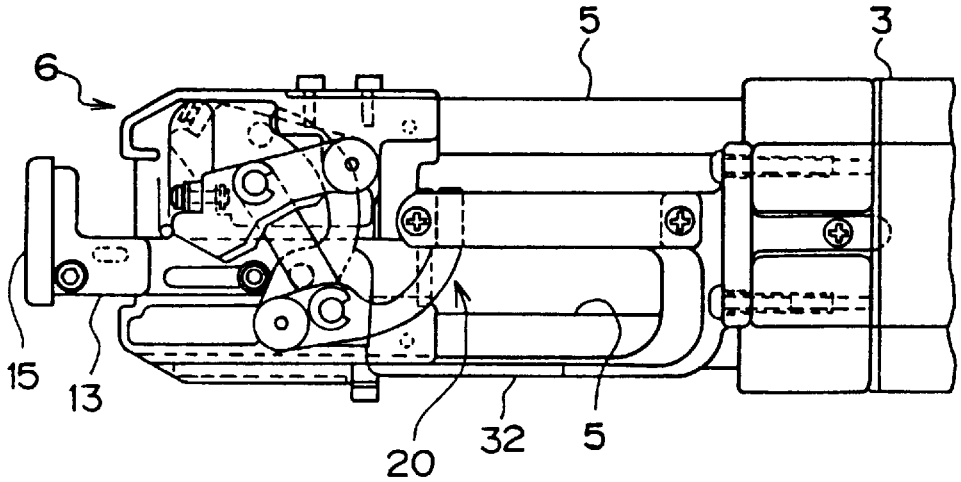
FIG. 4 is similarly a bottom view for showing the screw feeder mechanism body.

Referring now to the drawings, one preferred embodiment of the successive screw feeder driver of the present invention will be described as follows.

FIGS. 1 to 4 illustrate the successive screw feeder driver of the present invention.

The successive screw feeder driver 1 of the present invention is constructed such that a drive unit 4 is stored at an upper position of the rear section of the drive unit body 3 formed with a grip handle 2, and a screw feeder mechanism body 6 is fixed through a pair of guide poles 5, 5 in such a way that it may be slid in a forward or rearward direction in respect to the front section of the driving unit body 3. A piece of bit 7 for use in driving a screw S is arranged in parallel between these guide poles 5, 5 and then this bit 7 is removably connected to a rotary main shaft 10 in such a way that this bit 7 is rotationally driven through a reduction mechanism 8 and the rotary main shaft 10 constituted in the driving unit body 3. In turn, a magazine (not shown) having a screw chain 11 wound and stored therein is removably attached to the side surface of the driving unit body 3.

The bit 7 is a member corresponding to a screw driver of a general type tool, wherein it is comprised of a shaft member having a hexagonal shape in section. Both ends of the bit 7 are formed with (+)-shaped engaging protrusions 7*a* which can be engaged with the head section of the screw S, for example, the engaging grooves such as (+) grooves or the like. Near the engaging protrusions 7*a* is formed a groove 7*b* in a circumferential direction to which a chuck at the rotary main shaft 9 or the like is engaged. It is possible that the bit 7 can be used in such a way that its forward or rearward fixing position is replaced in response to a degree of wearing of the engaging protrusions 7*a* at both ends. In addition, when both engaging protrusions 7*a*, 7*a* are worn out together, it is possible that the worn-out bit is replaced with a new bit 7 and the replaced one can be used.

At a substantial central part of the screw feeder mechanism body 6 is arranged a hole 12 extending in its sliding direction. This hole 12 is used to cause the bit 7 to be rotatably inserted therein. To the extremity end of the screw feeder mechanism body 6 is fixed a leading end block 13 positioned in a direction of extension line of the hole 12. This leading end block 13 is made such that its extremity end is abutted against an object into which the screw S is threaded, i.e. either the plate member or the wall surface or the like and at the same time an abutting surface 15 having an L-shaped groove 14 for use in guiding the screw S to be driven is formed.

In addition, in a sliding direction at the upper surface of the screw feeder mechanism body 6 and its substantial central part is formed a screw feed groove 16 in a driving direction in such a way that the head section of the screw S can be pushed forward while it is being rotated together with the bit 7. Similarly, at the upper surface of the screw feeder mechanism body 6 is formed the screw head groove 17 up to the part of the screw feed groove 16 in such a way that the head section of the screw S fed from the left side of the screw feeder mechanism body 6 together with the screw chain 11 may be fed smoothly to the driving action applying position of the bit 7.

At the extremity end of the drive unit body 3 are formed through-holes 18, 18 for parallel two guide poles 5, 5 so as to enclose the bit 7 in a sliding direction. Resilient members 19, 19 such as coil springs or the like are assembled in the through-pass hole 18 for the guide pole 5. These resilient members 19 are used for always keeping the screw feeder mechanism body 6 at the pushing-out position (a forward position) with their resilient forces.

The drive unit body 3 and the screw feeder mechanism body 6 are provided with a screw feeder mechanism 20 for use in feeding out each of the screws S in the screw chain 11 in sequence in cooperation with the driving operation at the screw feeding mechanism body 6. The upper surface of the screw feeder mechanism 20 is provided with a screw cover 21. This screw cover 21 is constructed to be raised or indented in such a way that it may be oppositely faced against the screw head groove 17 formed at the screw feeder mechanism body 6 in order to guide the screw chain 11 fed out of a taking-out port of the magazine. That is, this screw cover 21 is oppositely arranged against the screw head groove 17 of the screw feeding mechanism body 6 and its rear end section is pivotally attached by a shaft stopper part 21*a* in such a way that it may be raised upwardly in a driving direction. In addition, the screw cover 21 is arranged in such a way that a position adjusting screw 23 is always abutted against a supporting section 22 projected at its rear part, wherein the shaft stopper section 21*a* is moved in a lateral direction (a leftward direction) to cause an abutment position of the position adjusting screw 23 in respect to the supporting section 22 to be displaced and then the screw cover 21 can be released widely in a forward and upward direction. Further, the position adjusting screw 23 may act to prevent the screw chain 11 from being released during screw driving operation under a state in which it is being abutted against the supporting section 22 of the screw cover 21. The screw cover 21 released in this way is set such that the side surface of the supporting section 22 is abutted against the position adjusting screw 23, its released state is kept by a biasing force of the resilient member 21*b* toward a right side of the shaft stopper section 21*a* and then the screw chain 11 can be easily released.

Figure 5:
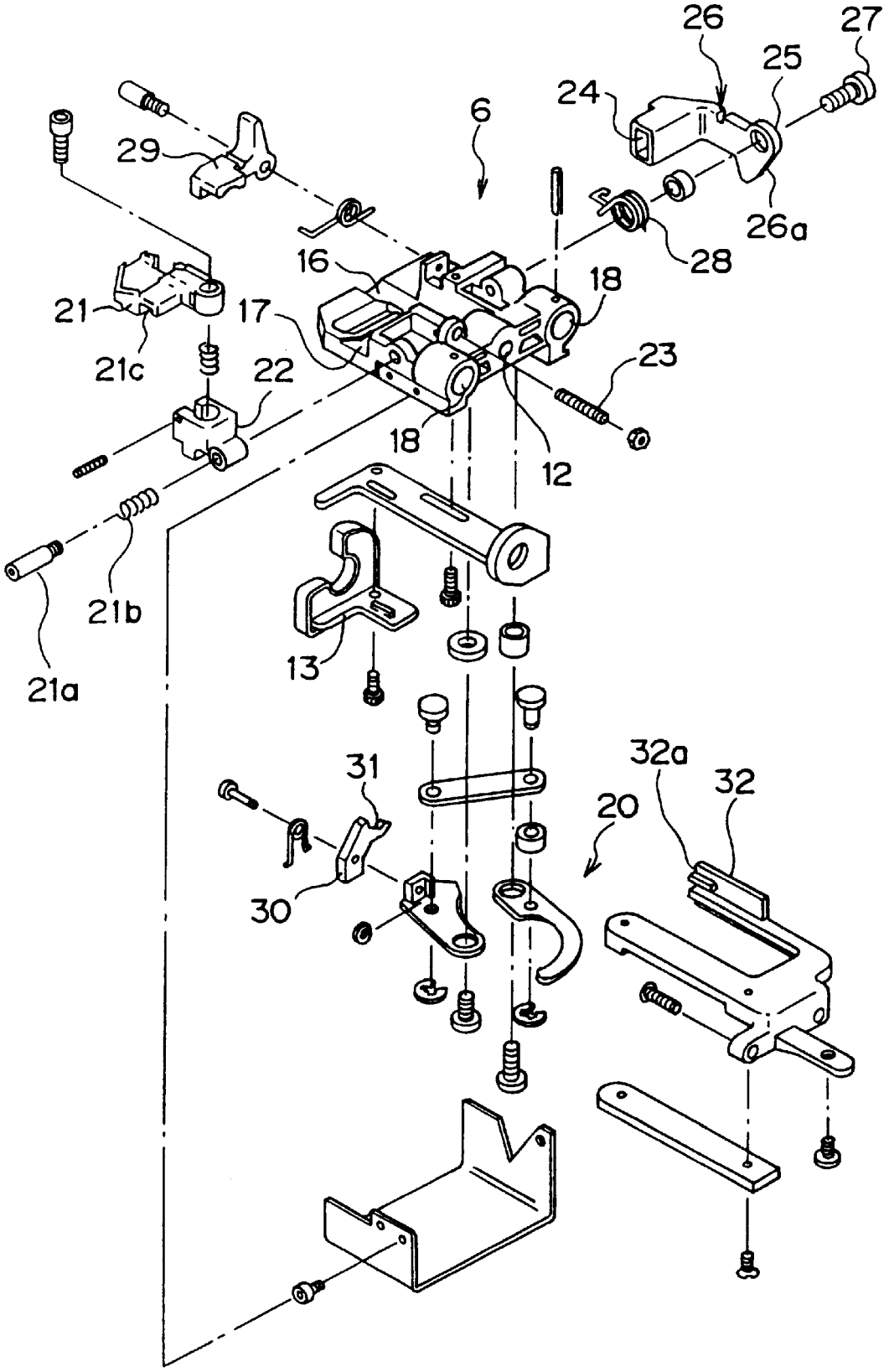
FIG. 5 is similarly an exploded perspective view for showing the screw feeder mechanism body.
Figure 6A:
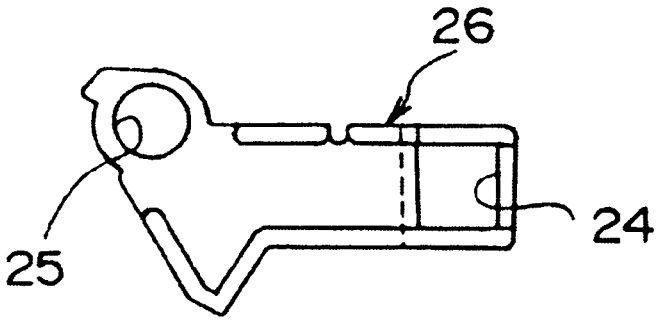
FIG. 6 illustrates a screw chain guide, wherein (a) is an enlarged side elevational view; (b) is an enlarged front elevational view and (c) is an enlarged top plan view, respectively.
Figure 6B:
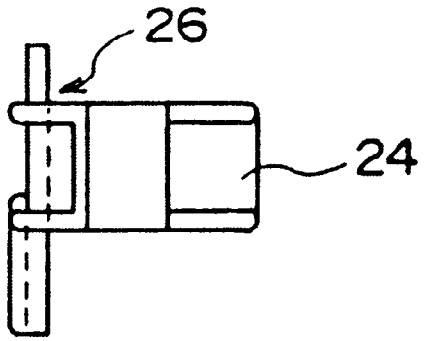
Figure 6C:
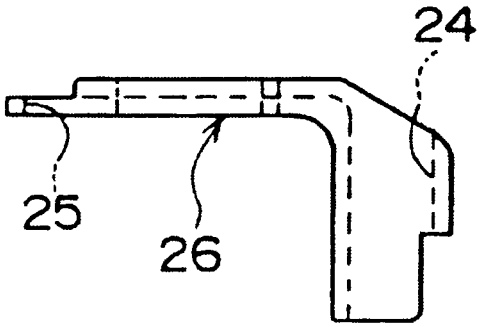
Figure 7A:
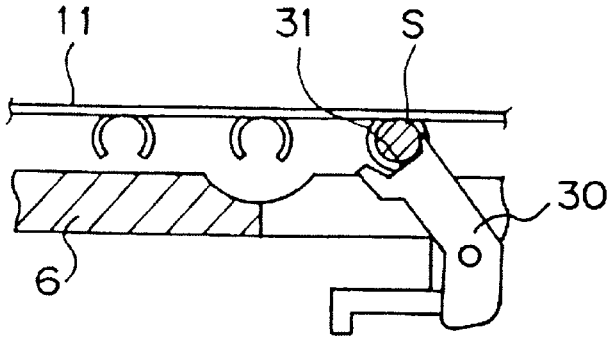
FIG. 7 illustrates an operating state of the feeder claw, wherein (a) is an illustration for showing a state in which a hook of the feeder claw is engaged with the screw, (b) is an illustration for showing a state in which the hook of the feeder claw feeds the screw up to a driving action applying position under its engaged state, (c) is an illustration for showing a state in which the feeder claw passes below a subsequent screw while it is being rotated and inclined, and (d) is an illustration for showing a state in which the feeder claw is returned back to the side surface of the screw and made upright and further the screw is engaged with the hook.
Figure 7B:
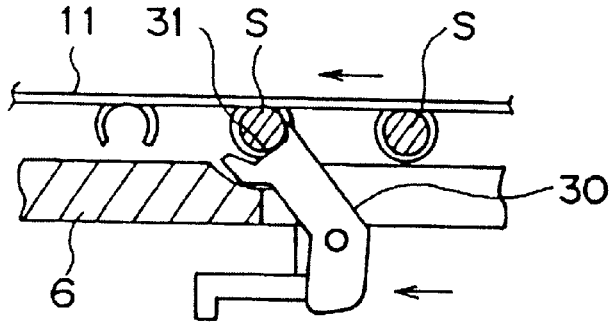
Figure 7C:
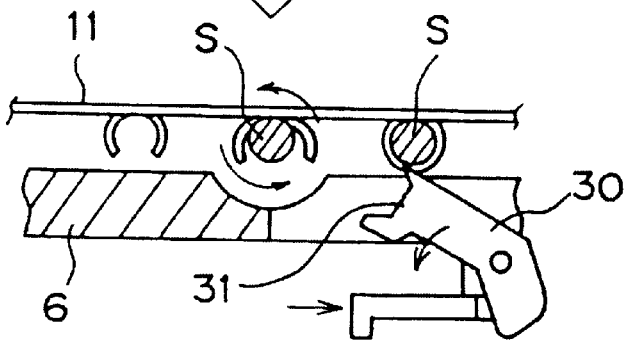
Figure 7D:
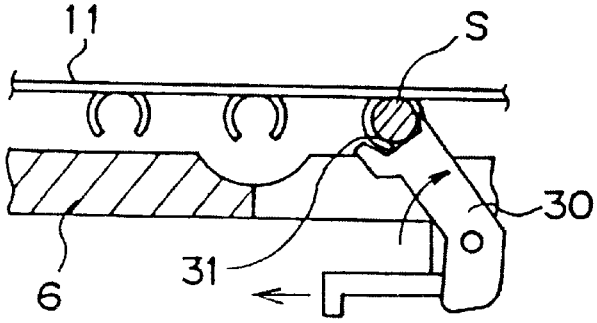

FIGS. 5 and 6 illustrate the screw chain guide and the pushing section for pushing up the screw chain guide.

A screw chain guide 26 formed at one end with a cylindrical guide passage 24 through which the screw chain 11 is passed and formed at the other end with a shaft hole 25 formed therethrough is rotatably pivoted at a side surface of the screw feeding mechanism body 6 positioned at an opposite side of the screw cover 21 with the screw feeding groove 16 being held therebetween. This screw chain guide 26 is a member which can be freely rotated around a rotating center of the pivoted shaft 27. This screw chain guide 26 can be turned only in an upward direction due to the fact that the guide passage 24 is abutted against the upper surface of the screw feeder mechanism body 6. This screw chain guide 26 is provided with a resilient member 28 such as a coil spring or the like for biasing the guide passage 24 in a downward direction toward the upper surface of the screw feeder mechanism body 6. The guide passage 24 is a cylindrical member having a slightly wider inner diameter than an outer size of the screw chain 11. In addition, in order to prevent the screw S from being displaced from its predetermined position, the upper surface of the screw feeder mechanism body 6 is provided with an engaging member 29 for producing a biasing force for pushing the screw chain 11 from above so as to be arranged at the guide passage 24 of the screw chain guide 26.

FIGS. 7(*a*), (*b*), (*c*) and (*d*) illustrate an operating state of a feeding claw constituting the screw feeder mechanism.

In concurrent with the returning of the screw feeder mechanism body 6 from the main body 3 of the drive unit to its original position, the screw feeder mechanism 20 is operated. This screw feeder mechanism 20 constitutes a feeder claw 30 capable of moving a subsequent screw S in the screw chain 11 to a feeding direction (a lateral direction) of the screw chain 11 in cooperation with a forward or rearward motion of the screw feeder mechanism body 6. At first, the feeder claw 30 is operated such that the threaded part of the screw S is engaged with the hook 31 (FIG. 7(*a*)). Then, the feeder claw 30 feeds this screw S up to the driving action applying position at the upper surface of the screw feeder mechanism body 6 under a state in which the threaded part of the screw S is engaged with the hook 31 (FIG. 7(*b*)). In concurrent with the driving operation of the screw S, the feeder claw 30 passes below the threaded part of the subsequent screw S while it is being turned and inclined against a spring force (FIG. 7(*c*)). Lastly, it is returned back and made upright in such a way that the hook part 31 of the feeder claw 30 is projected against the side surface of the threaded part of the screw S and then the hook part 31 is engaged with the threaded part of the subsequent screw S (FIG. 7(*d*)). Even in the case that the subsequent screw S in the screw chain 11 is displaced from its predetermined position, this hook part 31 can hold the screw S positively in such a way that it is abutted to enclose a range of about ⅓ of a circumference of the threaded part S1 of the screw S. Accordingly, the feeder claw 30 can move the screw S to the driving action applying position under a state in which the screw S is being held positively.

The inner surface of the screw cover 21 in accordance with the present invention is formed with a groove 21*c* in such a way that the head section of the screw S is slid in a feeding direction (a lateral direction) of the screw chain 11. This groove 21*c* is approximately opposed against the groove 17 of the head section of the screw at the screw feeder mechanism body 6. In view of the foregoing, the groove 21*c* can move the subsequent screw S in the screw rope 11 to the driving action applying position under a suitable state in cooperation with the hook part 31 formed at the extremity end of the aforesaid feeder claw 30.

Figure 8A:
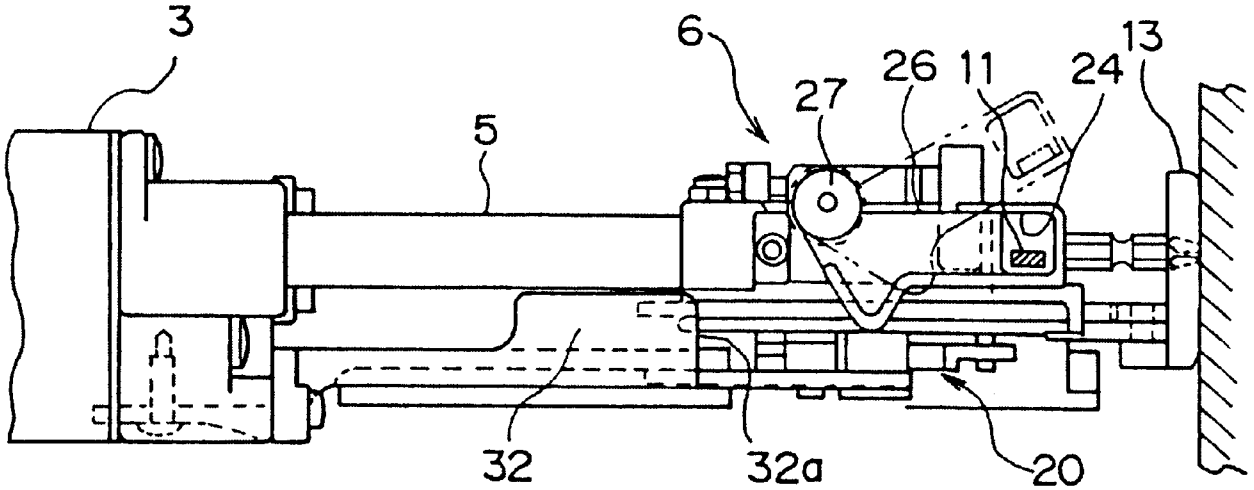
FIG. 8 illustrates a movable state of a screw chain guide at the screw feeder mechanism body, wherein (a) is a side elevational view for showing a state of the screw chain guide before it can be moved, and (b) is a side elevational view for showing a state after the screw chain guide can be moved.
Figure 8B:
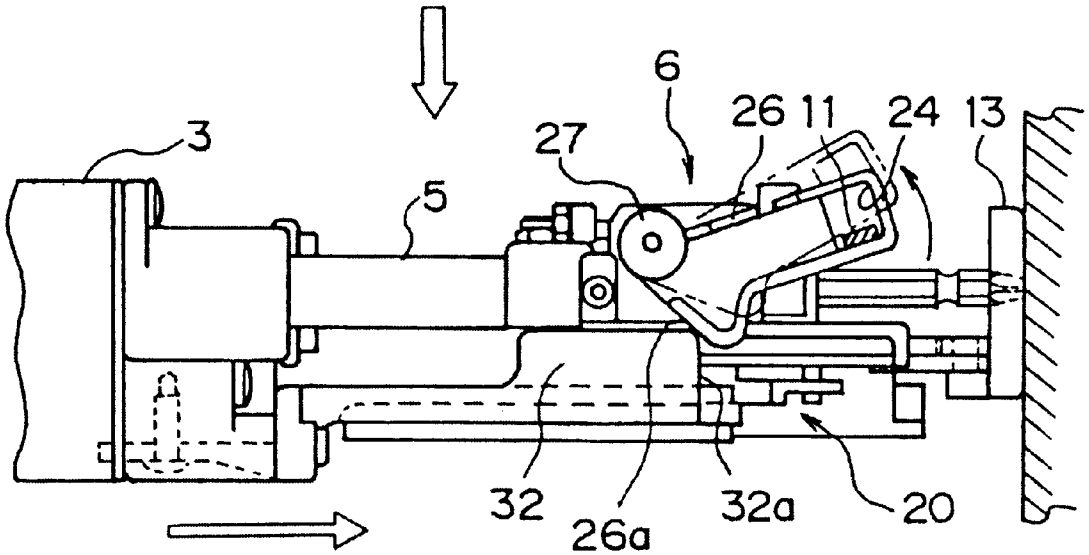
Figure 9A:
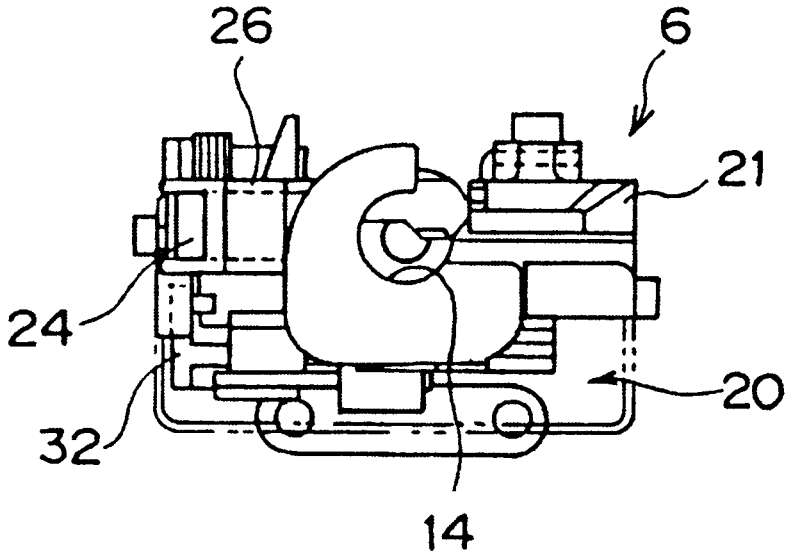
FIG. 9 illustrates a movable state of the screw chain guide at the screw feeder mechanism body, wherein (a) is a front elevational view for showing a state before the screw chain guide can be moved, and (b) is a front elevational view for showing a state in which the screw chain guide can be moved.
Figure 9B:
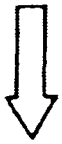
Figure 9B:
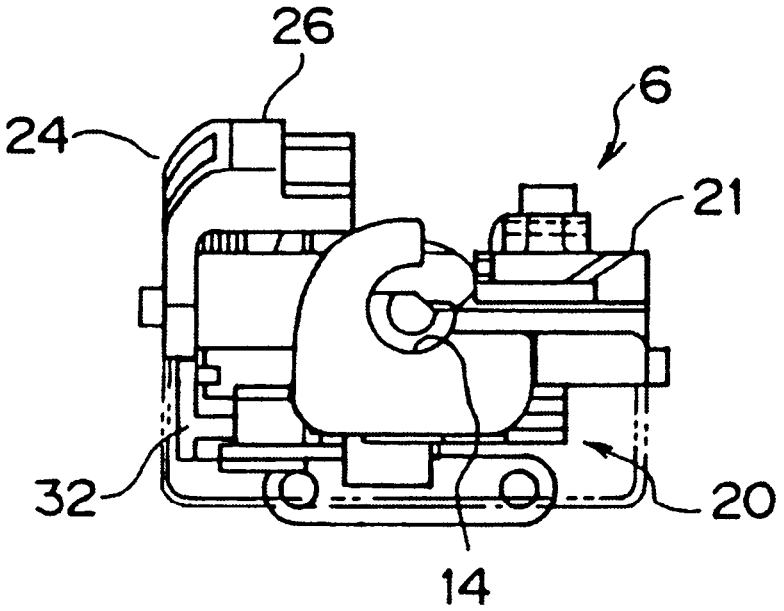
Figure 10A:
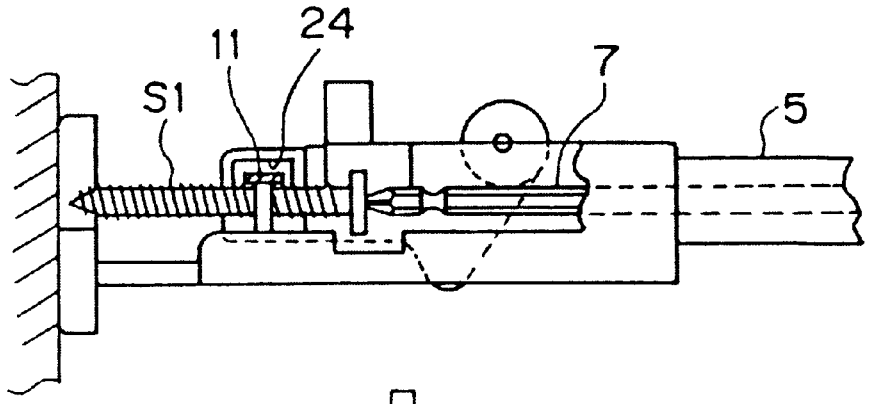
FIG. 10 illustrates a state in which the screw chain is lifted up, wherein (a) is an illustration for showing a state before the screw chain is lifted up, (b) is an illustration for showing a state in the midway part of lifting up the screw chain, and (c) is an illustration for showing a state in which the screw chain is lifted up.
Figure 10B:
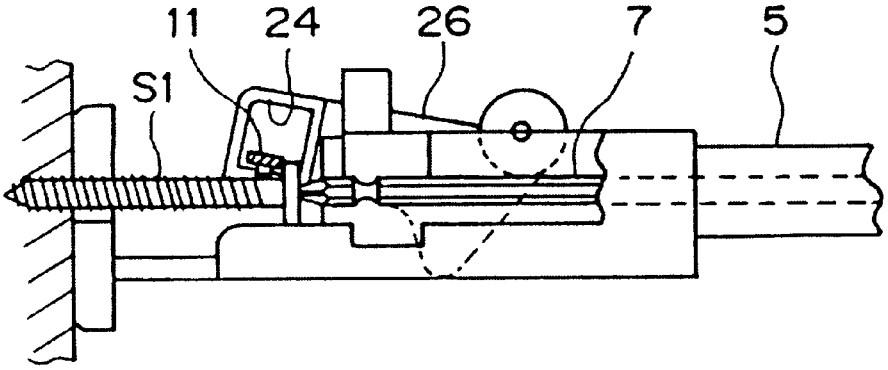
Figure 10C:
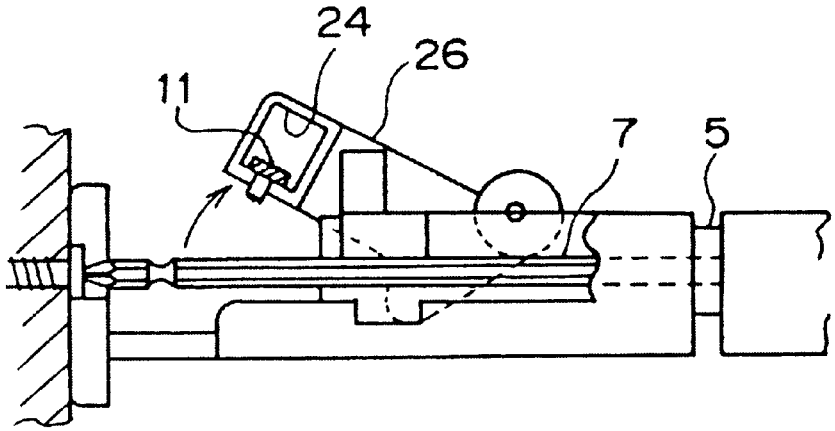
Figure 11:
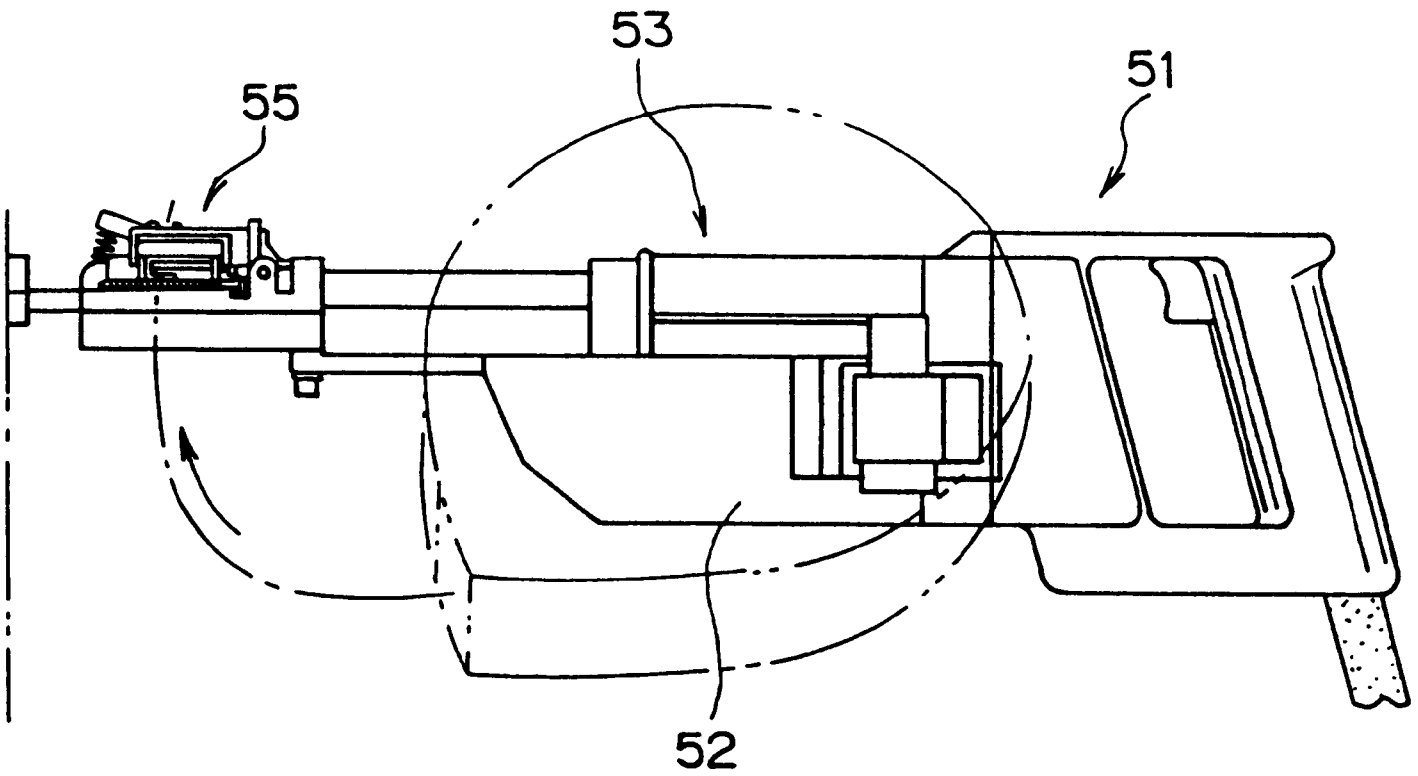
FIG. 11 is a side elevational view for showing an entire successive screw feeder driver of the prior art.
Figure 12:
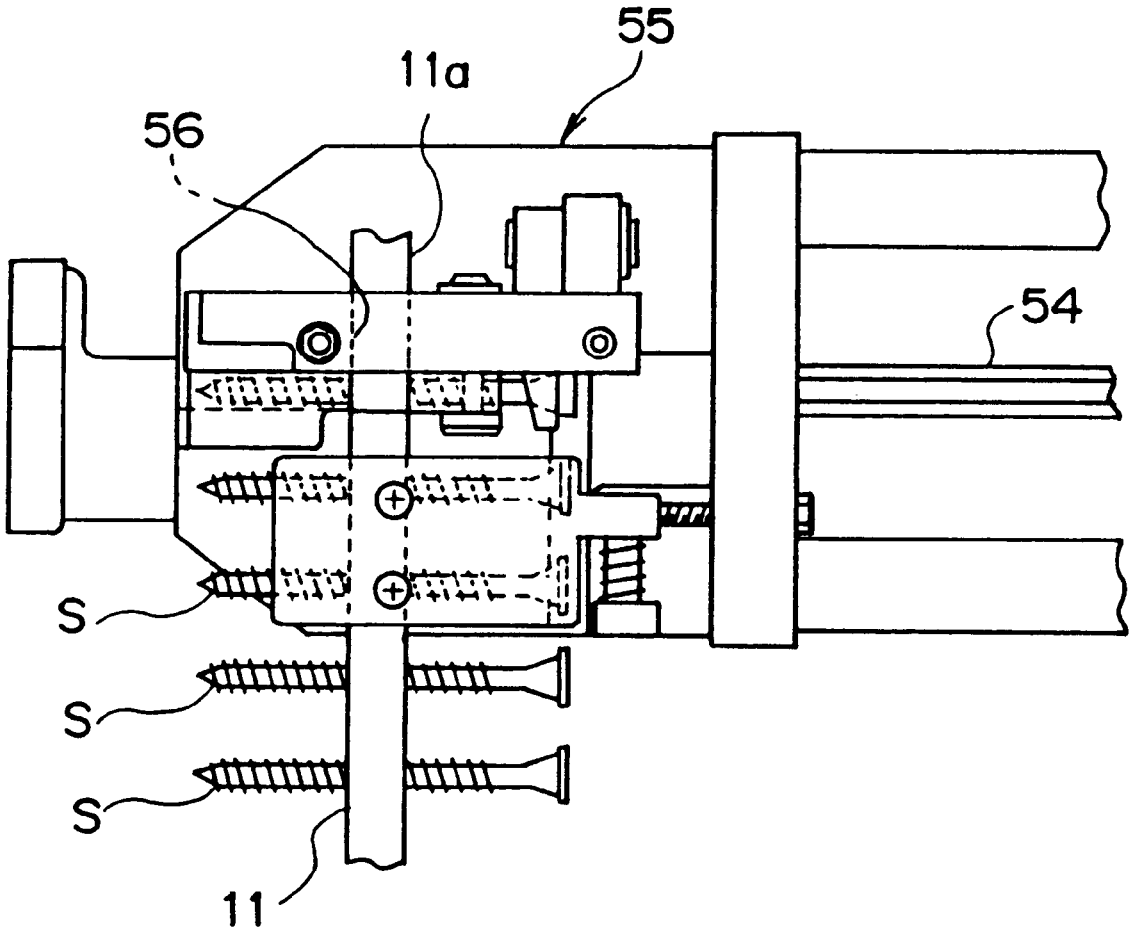
FIG. 12 is an enlarged top plan view for showing the screw feeder mechanism body of the prior art.
Figure 13A:
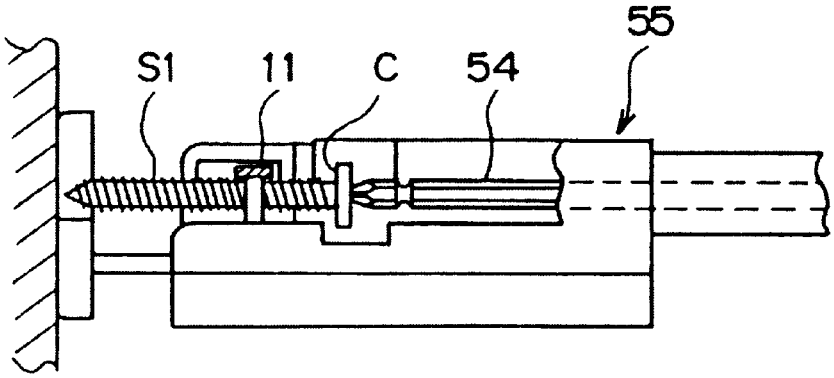
FIG. 13 illustrates a state in which a screw chain having a screw removed therefrom is held at the seat surface of the screw, wherein (a) is an illustration for showing a state before the screw is removed, and (b) is an illustration for showing a state after the screw is removed.
Figure 13B:
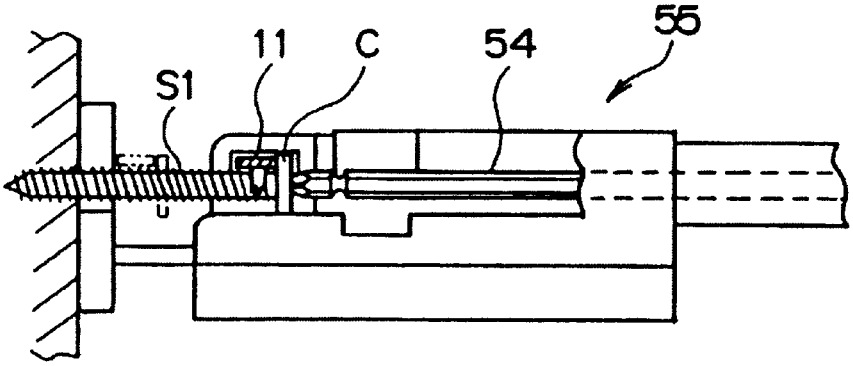
Figure 14A:
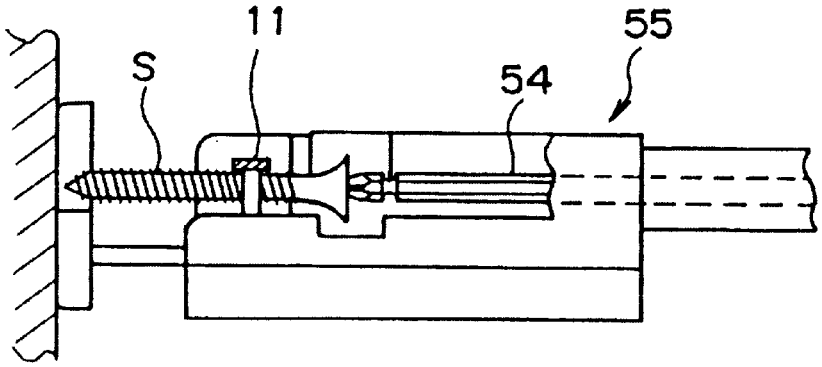
FIG. 14 illustrates a state in which a pan-like screw is removed from the screw chain, wherein (a) is an illustration for showing a state before the screw is removed and (b) is an illustration for showing a state after the screw is removed.
Figure 14B:
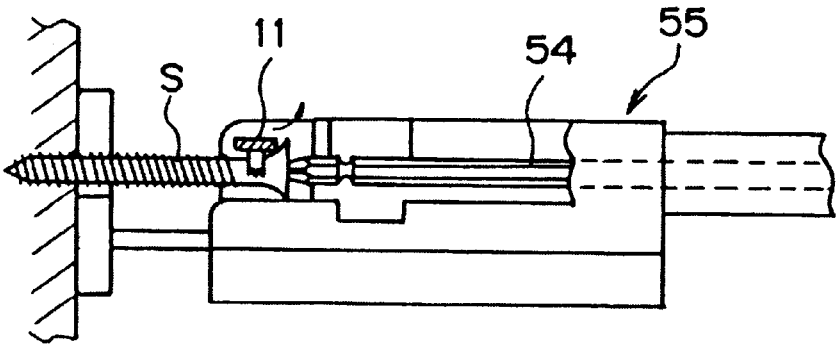
Figure 15A:
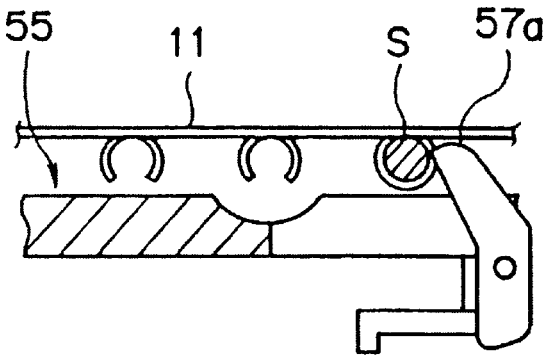
FIG. 15 illustrates an operating state of the feeding claw constituting the screw feeder mechanism of the prior art, wherein (a) is an illustration for showing a state in which the feeder claw is engaged with the screw, (b) is an illustration for showing a state in which the feeder claw feeds the screw up to the driving action applying position under its engaged state, (c) is an illustration for showing a state in which the feeder claw passes below a subsequent screw while it is being rotated and inclined, and (d) is an illustration for showing a state in which the feeder claw is returned back to the side surface of the screw and made upright.
Figure 15B:
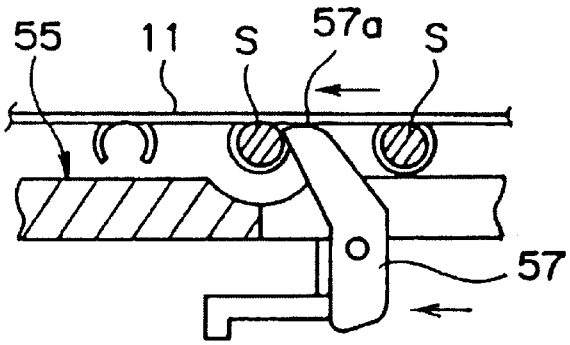
Figure 15C:
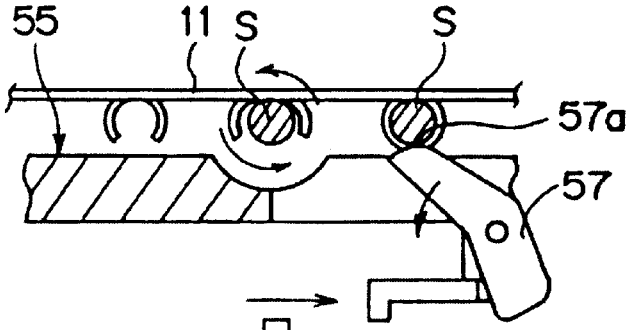
Figure 15D:
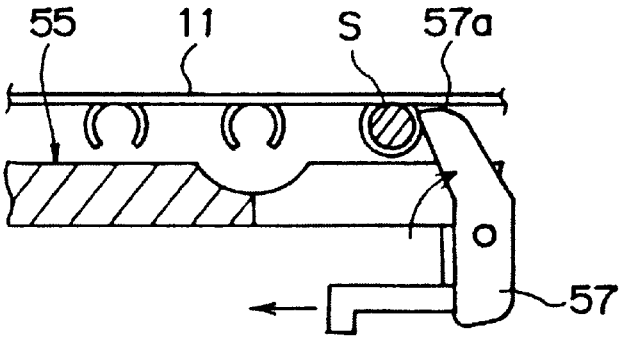

FIGS. 8 to 10 illustrate a movable state of the screw chain guide.

The front part of the drive unit body 3 is provided with a rod-like pushing section 32 in such a way that the pushing part may become in parallel with the bit 7 as well as the guide poles 5, 5. On the extended line of the axis of the pushing section 32 is arranged the lower part 26*a* near the shaft hole 25 of the screw chain guide 26 (FIG. 8(*a*)). In concurrent with the driving operation of the screw S, the screw chain guide 26 retracted together with the screw feeder mechanism body 6 is operated such that its lower part 26*a* is abutted against the extremity end 32*a* of the pushing part 32 (FIG. 8(*b*)). The screw chain guide 26 lifts up the guide passage 24 at the extremity end of the screw chain guide 26 around a fulcrum point of the pivoted shaft 27. In this way, the screw chain 11 inserted into the guide passage 24 is lifted up in an upward direction (FIG. 8(*b*), FIG. 9(*b*)).

When the leading end block 13 of the screw feeder mechanism body 6 is removed from the plate member, the screw feeder mechanism body 6 is moved away from the fastening machine body 3 and advances forwardly and it is moved away from the pushing section 32 which keeps pushing up the lower part 26*a* of the screw chain guide 26. At this time, the screw chain guide 26 is operated such that the extremity end guide passage 24 is returned back to the predetermined position of the screw feeder mechanism body 6 by a downward-directed biasing force of the resilient member 28 around a fulcrum point of the shaft hole 25.

An operating method for the successive screw feeder driver of the present invention will be described.

At first, the worker loads the extremity end 11*a* of the screw chain 11 wound within the magazine to the screw feeder mechanism body 6 kept at a state in which the screw cover 21 is closed. Then, the worker holds with a hand a grip handle 2 of the successive screw feeder driver 1, fixes the screw chain 11 in such a way that the first screw S comes to the position before one location to the screw S driving position and then pushes down the screw feeder mechanism body 6. At this time, the first screw S is fed out to the driving action applying position (a position of the screw feeding groove 16) under a feeding action of the feeder claw 30 of the screw feeder mechanism 20 and the head section of the screw S is moved to the central position of the bit 7. Further, the worker arranges the screw S at the driving action applying position of the bit 7 and inserts the screw chain 11 at the extremity end side of the screw S into the guide passage 24 of the screw chain guide 26. Then, the screw chain 11 is pressed by the engaging member 29 and then the abutting surface 15 of the leading end block 13 is pushed against the object (a surface of the plate member).

The worker pushes a trigger switch 33 contacted with a fore-finger of the grip handle 2 under this pushed state and rotates the drive unit 4 within the drive unit body 3. This drive unit 4 rotates the bit 7 connected to the rotary main shaft 10 through the reduction mechanism 8 and the clutch 9 and the screw S is gradually driven against the plate member. In concurrent with this driving of this screw S, the screw feeder mechanism body 6 is retracted gradually toward the drive unit body 3 so as to complete the driving operation for one piece of screw S.

In turn, when the screw feeder mechanism body 6 is retracted in concurrent with the driving of the screw S, the extremity end 32*a* of the pushing part 32 is abutted against the lower part 26*a* of the screw chain guide 26. At this time, the screw chain guide 26 is turned upwardly around a fulcrum point of the pivoted shaft 27 to enable the screw chain 11 inserted into the guide passage 24 located at the extremity end of the screw chain guide 26 to be lifted up in an upward direction. Accordingly, the screw chain 11 is not held between the seat surface of the head section of the screw S and the plate member.

Then, upon completion of fastening of one piece of screw S, in the case that the successive screw feeder driver 1 is retracted from the plate member, the screw feeder mechanism body 6 is pushed out by a biasing force of the resilient members 19, 19 from the fastening machine body 3 to its original position. At this time, the feeder claw 30 of the screw feeder mechanism 20 feeds out the subsequent screw S in the screw chain 11 to the driving action applying position. Thus, it is possible to perform the screw driving operation in the same operating manner as that of the foregoing operation. When the worker removes the leading end block 13 of the screw feeder mechanism body 6 from the plate member, the screw feeder mechanism body 6 is moved away from the drive unit body 3 and advances in a forward direction and also the pushing section 32 pushing up the lower part 26*a* of the screw chain guide 26 is also moved away. The screw chain guide 26 is operated such that the guide passage 24 is returned back to its predetermined position of the screw feeder mechanism body 6 by a biasing force directed in a downward direction around the rotating center of the shaft hole 25. The screw S moved up to the driving action applying position waits for the driving operation at this position, a similar operation is repeated in its subsequent action and then the driving operation for the screw S can be carried out successively.

The successive screw feeder driver 1 of the present invention enables the screw chain 11 to be engaged with and held at the screw cover 21 when the screw S is fastened and further enables the head section of the screw S fixed to the screw chain 11 to be held by the groove 17 at the head section of the screw in such a way that it may not be pulled out. In turn, the screw chain 11 left after driving of the screw S is lifted up by the guide passage 24 in an upward direction. Thus, it is possible that the screw S is guided into the L-shaped groove 14 of the leading end block 13 while keeping a quite stable attitude and the screw chain 11 has a strength in its chain for restricting an inclination of the screw S. Under an effective application of this force, the successive screw feeder driver 1 in accordance with the present invention shows that the screw S is not inclined in random manner against the object and so the screw S can be fastened in a straight manner.

In addition, the preferred embodiment of the present invention shows an example of the successive screw feeder driver 1 constructed such that as shown in FIG. 1, the drive unit 4 is stored at an upper position of the rear part of the drive unit body 3 formed with the grip handle 2 and at the same time the screw feeder mechanism body 6 is fixed through a pair of guide poles 5, 5 in such a manner that it may be slid in a forward or rearward direction against the front part of the drive unit body 3. However, the present invention is not limited to the successive screw feeder driver 1 having such a configuration as that of the drive unit 4 or the grip handle 2 and the screw chain guide 26 or the feeder claw 30 having the hook 31 in accordance with the present invention can be assembled.

INDUSTRIAL APPLICABILITY OF THE INVENTION

The successive screw feeder driver in accordance with the present invention is operated such that the screw at the extremity end of the screw chain in respect to the screw feeder mechanism body can be loaded at the drive action applying position in a fast and accurate manner. In addition, the screw chain can be inserted into the guide passage of the screw feeder mechanism and a displacement of the screw chain can be eliminated. Further, the hook part formed at the extremity end of the feeder claw of the screw feeder mechanism can grip a subsequent screw in a positive manner and perform a positive screw feeding operation when the driving operation is carried out. In particular, the screw chain guide lifts up the screw chain inserted into the guide passage in an upward direction to eliminate a disadvantage that the seat surface of the screw drives the screw chain and enables the driving action for the successive screw to be performed in an accurate manner.

What is claimed is:

1. A successive screw feeder driver in which a bit for driving a screw is rotatably inserted into a screw feeder mechanism body freely slid in a forward or rearward direction, said bit is removably arranged at the front section of a rotary main shaft, a drive unit is connected to said rotary main shaft;

said screw feeder mechanism body is provided with a screw feeder mechanism comprised of a feeder claw for feeding each of the screws in a screw chain in sequence to a driving action applying position with said bit in cooperation with a sliding motion of said screw feeder mechanism body in a forward or rearward direction;

a screw chain guide having a guide passage at one end thereof and provided with a shaft hole at the other end thereof is rotatably pivoted to the side surface of said screw feeder mechanism body, said pivoted section is provided with a resilient member for biasing the guide passage for said screw chain guide against the upper surface of said screw feeder mechanism body in a downward direction;

a pushing section abutted against the lower part near the shaft hole of said screw chain guide is projected and arranged at said drive unit body, the guide passage side of the screw chain guide is pushed up by said pushing section in an upward direction and then the screw chain inserted into the guide passage can be lifted up in an upward direction in cooperation with a driving action of said bit.

2. A successive screw feeder driver according to claim 1, wherein said guide passage is of a cylindrical member having a slight wider inner diameter than an outer size of the screw chain.

3. A successive screw feeder driver according to claim 1, wherein the extremity end of the feeder claw constituting said screw feeder mechanism is formed with a hook section.

4. A successive screw feeder driver according to claim 1, wherein a screw cover is arranged at the upper surface of said screw feeder mechanism body in such a manner that it can be raised up or descended and then the inner surface of said screw cover is formed with a groove for the head section of the screw arranged in a vertical direction in respect to a screw driving direction.

* * * * *